US008079166B2

(12) United States Patent
Li et al.

(10) Patent No.: US 8,079,166 B2
(45) Date of Patent: Dec. 20, 2011

(54) SUPPORT ASSEMBLY AND DIGITAL PHOTO FRAME USING THE SAME

(75) Inventors: Ming Li, Shenzhen (CN); Chi-Hsie Fong, Taipei Hsien (TW); Kun-Chih Hsieh, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 209 days.

(21) Appl. No.: 12/483,256

(22) Filed: Jun. 12, 2009

(65) Prior Publication Data

US 2010/0084538 A1 Apr. 8, 2010

(30) Foreign Application Priority Data

Oct. 6, 2008 (CN) ..... 2008 1 0304738

(51) Int. Cl.
*E04G 3/00* (2006.01)
*A47G 1/16* (2006.01)

(52) U.S. Cl. ..... 40/748; 40/606.15; 248/292.12

(58) Field of Classification Search ..... 40/748, 40/749, 606.13, 606.15; 248/292.12, 292.13
See application file for complete search history.

(56) References Cited

U.S. PATENT DOCUMENTS

| | | | | |
|---|---|---|---|---|
| 2,448,580 | A * | 9/1948 | Crosby | 248/463 |
| 2,539,781 | A * | 1/1951 | Heaney | 108/27 |
| 5,751,548 | A | 5/1998 | Hall et al. | |
| 2007/0075208 | A1 * | 4/2007 | Chen | 248/455 |

FOREIGN PATENT DOCUMENTS

| | | |
|---|---|---|
| CN | 2874554 | 2/2007 |

* cited by examiner

*Primary Examiner* — Casandra Davis
(74) *Attorney, Agent, or Firm* — Altis Law Group, Inc.

(57) ABSTRACT

A support assembly for a digital photo frame is provided. The support assembly comprises a base member, a pivot member, a support arm, a positioning structure, and a an elastic member. The base member comprises two side walls spaced from each other. The support arm comprises a connection end disposed between the two side walls and is rotatably attached to the base member via the pivot member. The connection end comprises a first surface and a second surface opposite to each other. The pivot member is attached across the two side walls. The positioning structure is disposed on the first surface and the side wall opposite the first surface and comprises a projection portion and at least two concave portions. The projection portion is capable of being received in the at least two concave portions, the two concave portions intersect to form an edge.

10 Claims, 7 Drawing Sheets

SUPPORT ASSEMBLY AND DIGITAL PHOTO FRAME USING THE SAME

BACKGROUND

1. Technical Field

The present disclosure relates to component support assemblies and, more particularly, to a support assembly used for a digital photo frame.

2. Description of Related Art

Digital photo frames are devices for displaying electronic image files and usually include a stand to support the digital photo frame. One common type of stand usually includes a leg which is pivotally hinged about a horizontal axis. When in use, the leg can be angularly displaced between a first position in which it lies generally flush with the rear face of the back cover of the digital photo frame and a second or extended limiting position in which it lies at an angle to the rear face. With the leg in its extended position, the digital photo frame can stand stably on a horizontal surface in an upright or slightly leaning back attitude, being supported in this state by the leg.

This type of stand usually also includes a fixing structure to keep the leg in the first position and/or the second position. One fixing structure is simply achieved via the frictional force between the leg and the hinge to which the leg is attached. Other fixing structures are also used.

Although this type of stand with these fixing structure works up to the expectations, a stand with a new and better fixing structure is still needed.

DETAILED DESCRIPTION

Figure 1:
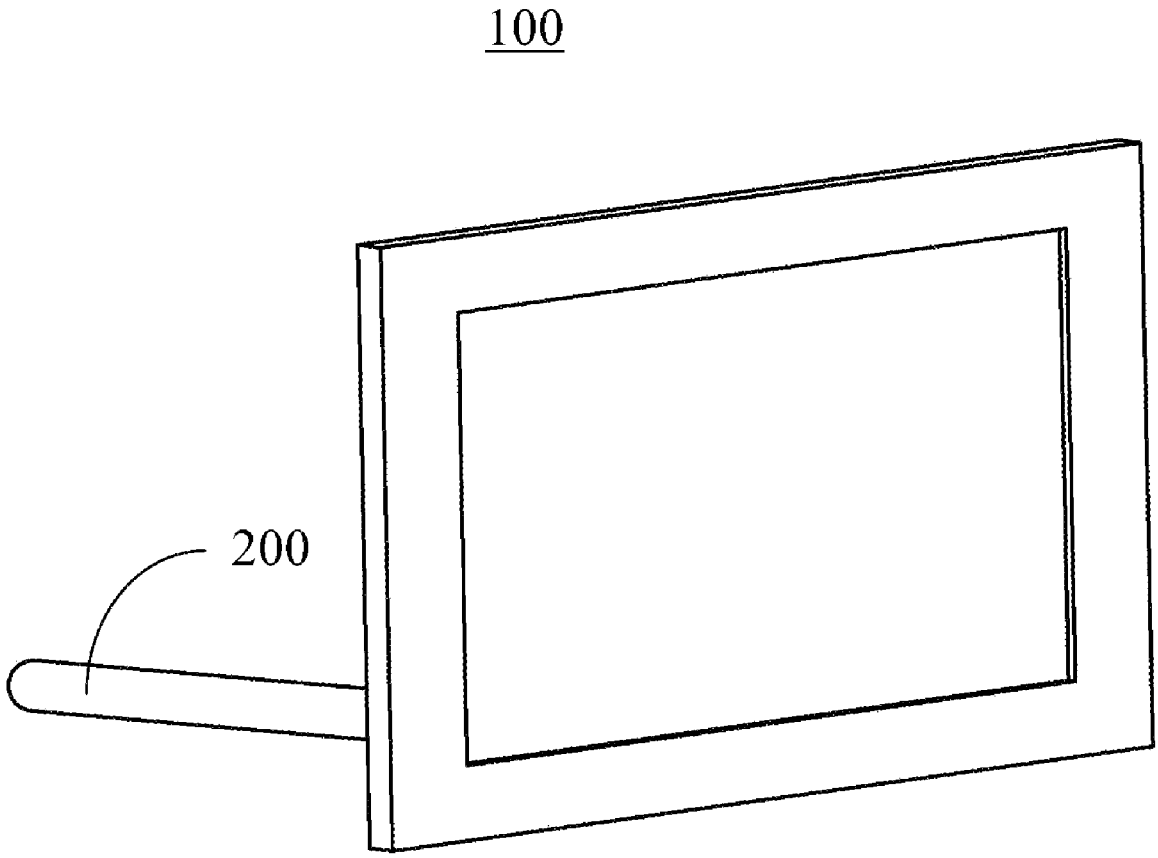
FIG. 1 is an isometric view of a digital photo frame in accordance with an exemplary embodiment of the present disclosure.
Figure 2:
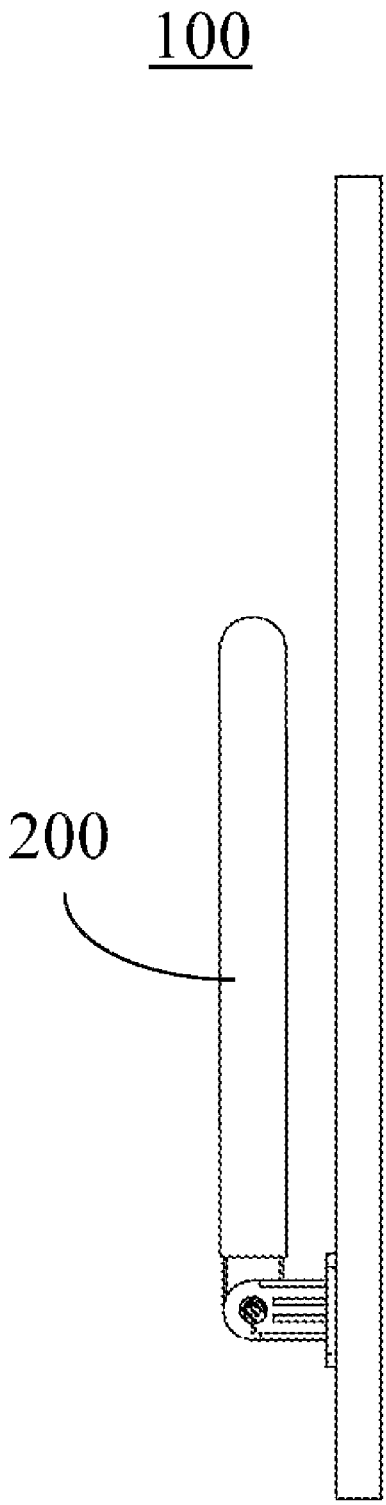
FIG. 2 is a top view of the digital photo frame of FIG. 1, which shows a stand retained in a closed position.
Figure 3:
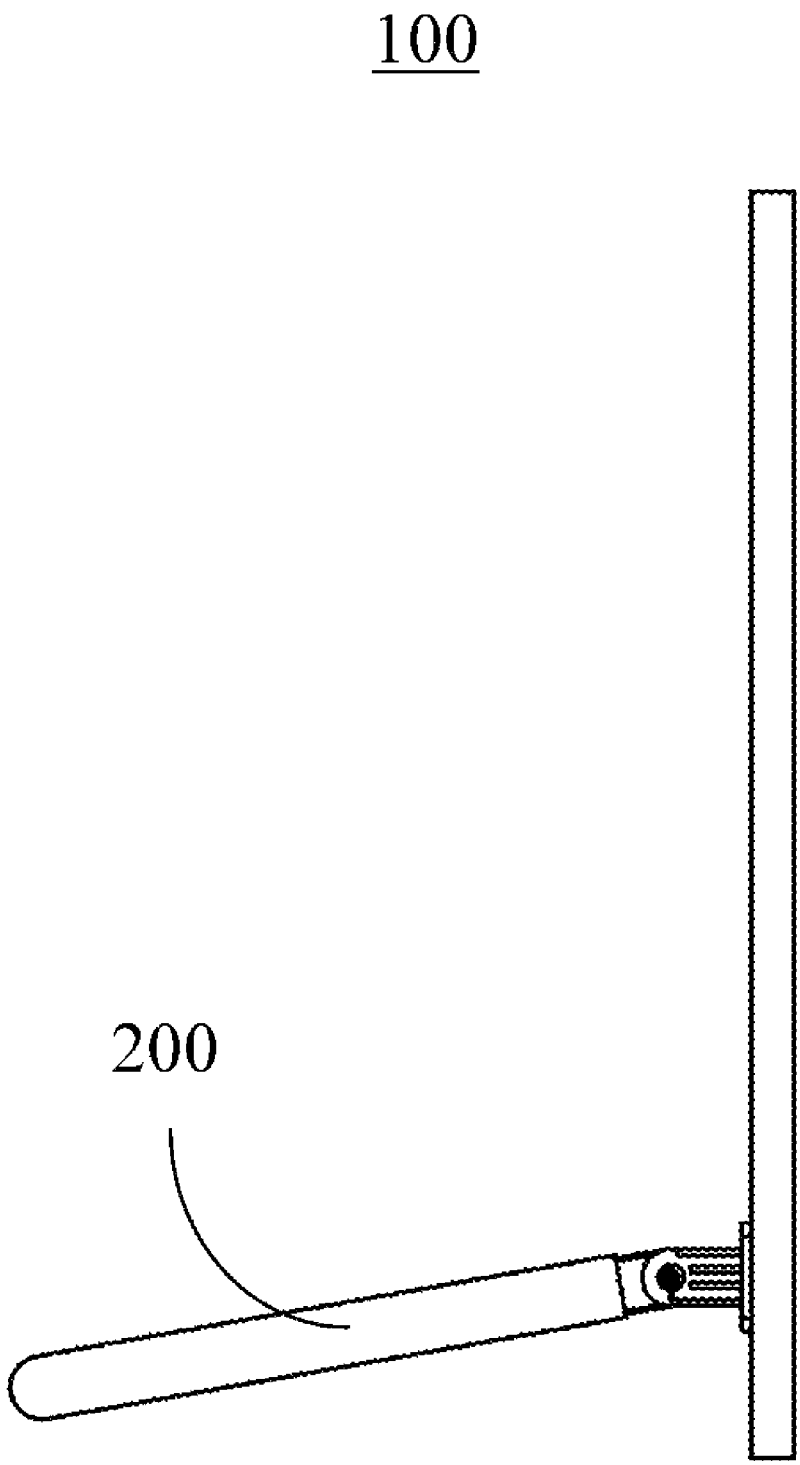
FIG. 3 is a top view of the digital photo frame of FIG. 1, which shows a stand retained in an open position.

FIG. 1 shows a digital photo frame 100 in accordance with an exemplary embodiment of the present disclosure. The digital photo frame 100 includes a front cover, a display device, a back cover, and a stand 200. FIGS. 2 and 3 are top views of the digital photo frame 100, which show respectively the stand 200 in a closed position and in an open position.

Figure 4:
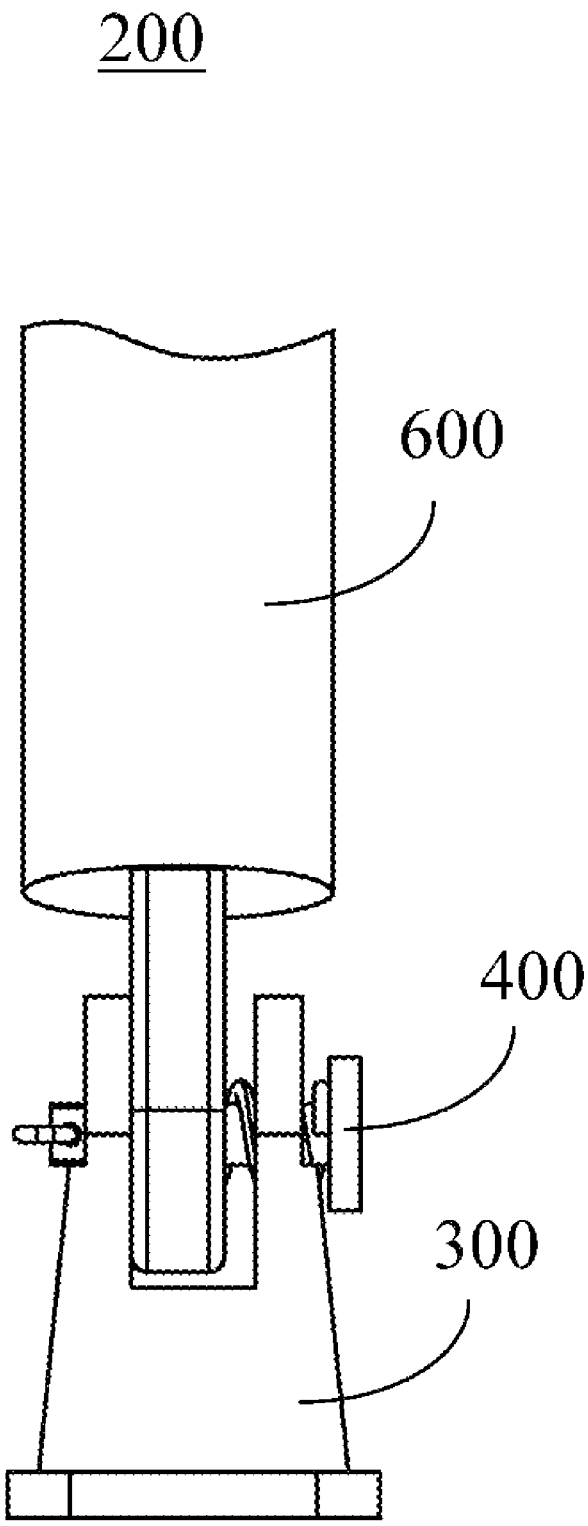
FIG. 4 is a partial, isometric, assembled view of the stand of FIG. 2.
Figure 5:
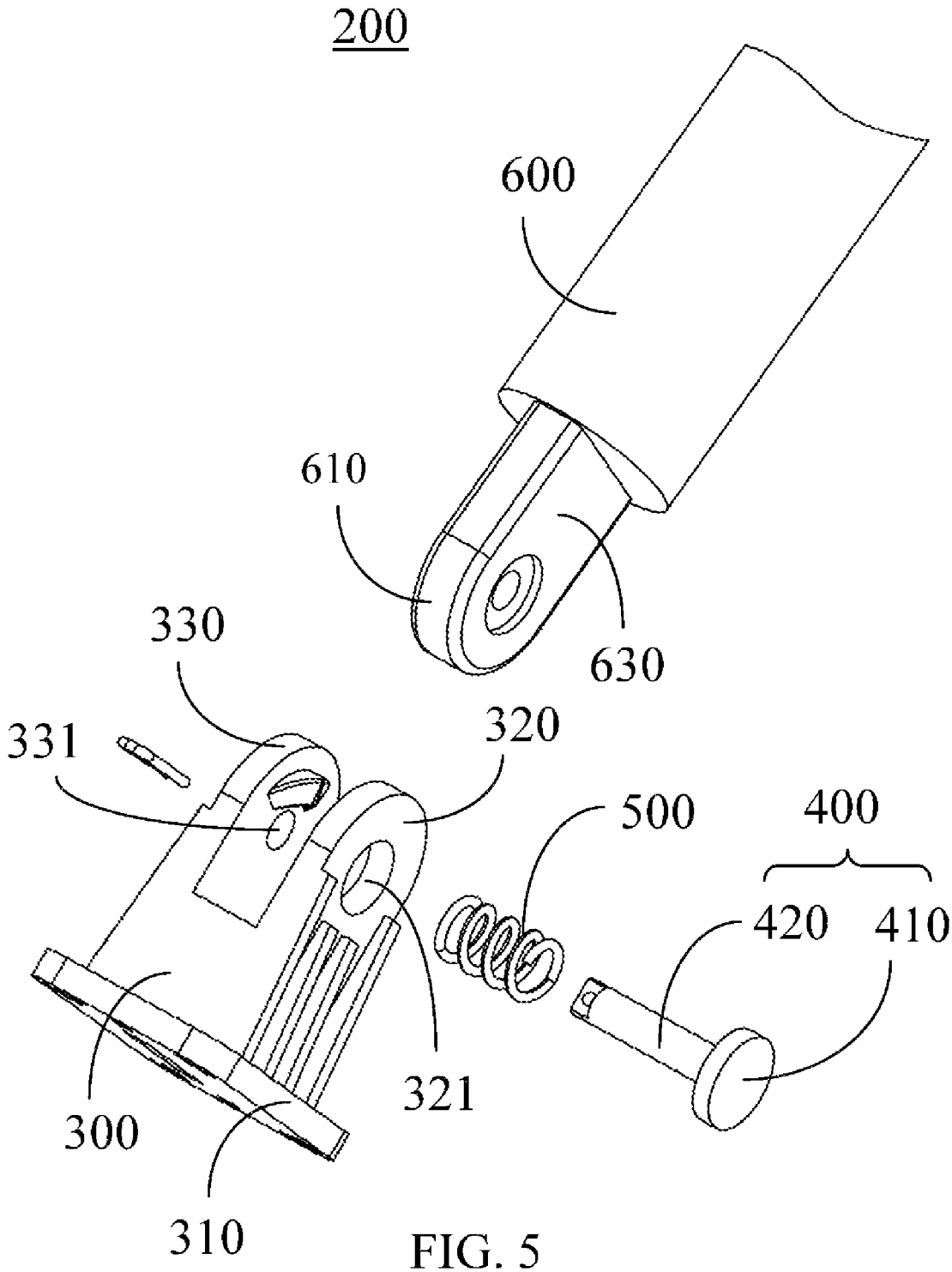
FIG. 5 is an isometric, exploded view of the stand of FIG. 4.
Figure 6:
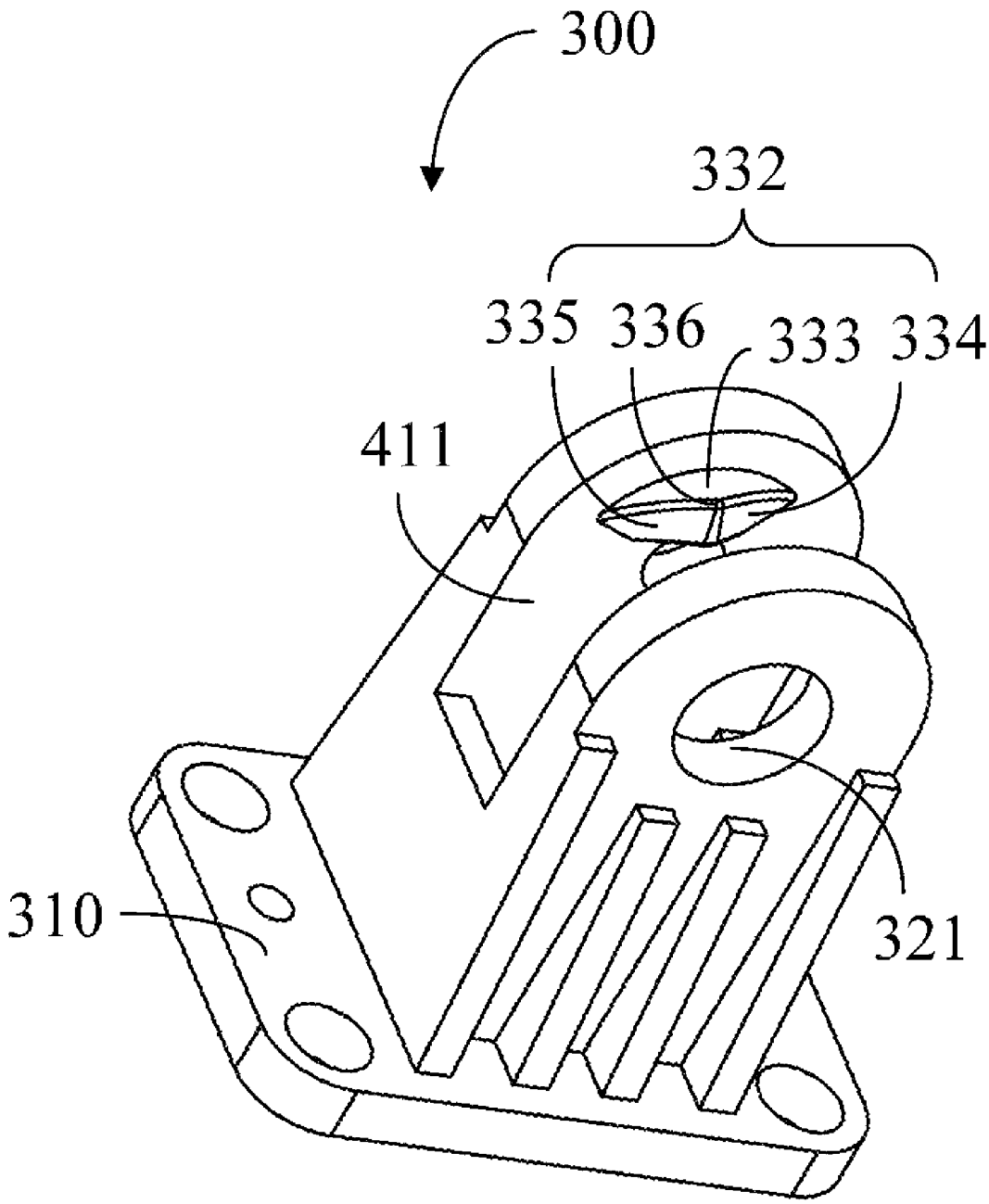
FIG. 6 is an isometric view of a base member of FIG. 5.

Referring to FIGS.4 through 6, the stand 200 attached to the back cover includes a base member 300, a pivot member 400, an elastic member 500, and a leg 600. The base member 300 includes a bottom portion 310 that is mounted on the back cover. The base member also includes a first wall 320 and a second wall 330 protruded from the bottom portion 310. The first wall 310 and the second wall 320 are spaced from each other.

A bearing hole 321 is formed on the first wall 320 and a bearing hole 331 is formed on the second wall 330. The bearing hole 321 is formed larger than the bearing hole 331.

The two bearing holes 321, 331 are substantially coaxially formed about an axis that is perpendicular to the first and second walls 320, 330.

A projection portion 332 is formed on an inner side surface of the second wall 330. Specifically, the projection portion 332 extends from the inner surface and towards the first wall 320. The projection portion 332 is positioned adjacent the bearing hole 331. In one embodiment, the projection portion 332 includes an upper cylindrical surface 333, a first lower inclined surface 334, and a second lower inclined surface 335.

In one embodiment, the surface 333 has an axis generally aligned coaxially with the axis of the bearing holes 321, 331. The surfaces 333, 334, and 335 join together to form a tip portion 336.

Referring back to FIGS. 4 and 5, the pivot member 400 includes a flat head 410 and a shaft portion 420 extended therefrom. The pivot member 400 is attached to the base member, with the shaft portion 420 extending through the bearing holes 321 and 331. In the embodiment shown, the elastic member 500 is a coil spring and is placed on the shaft portion 420.

Figure 7:
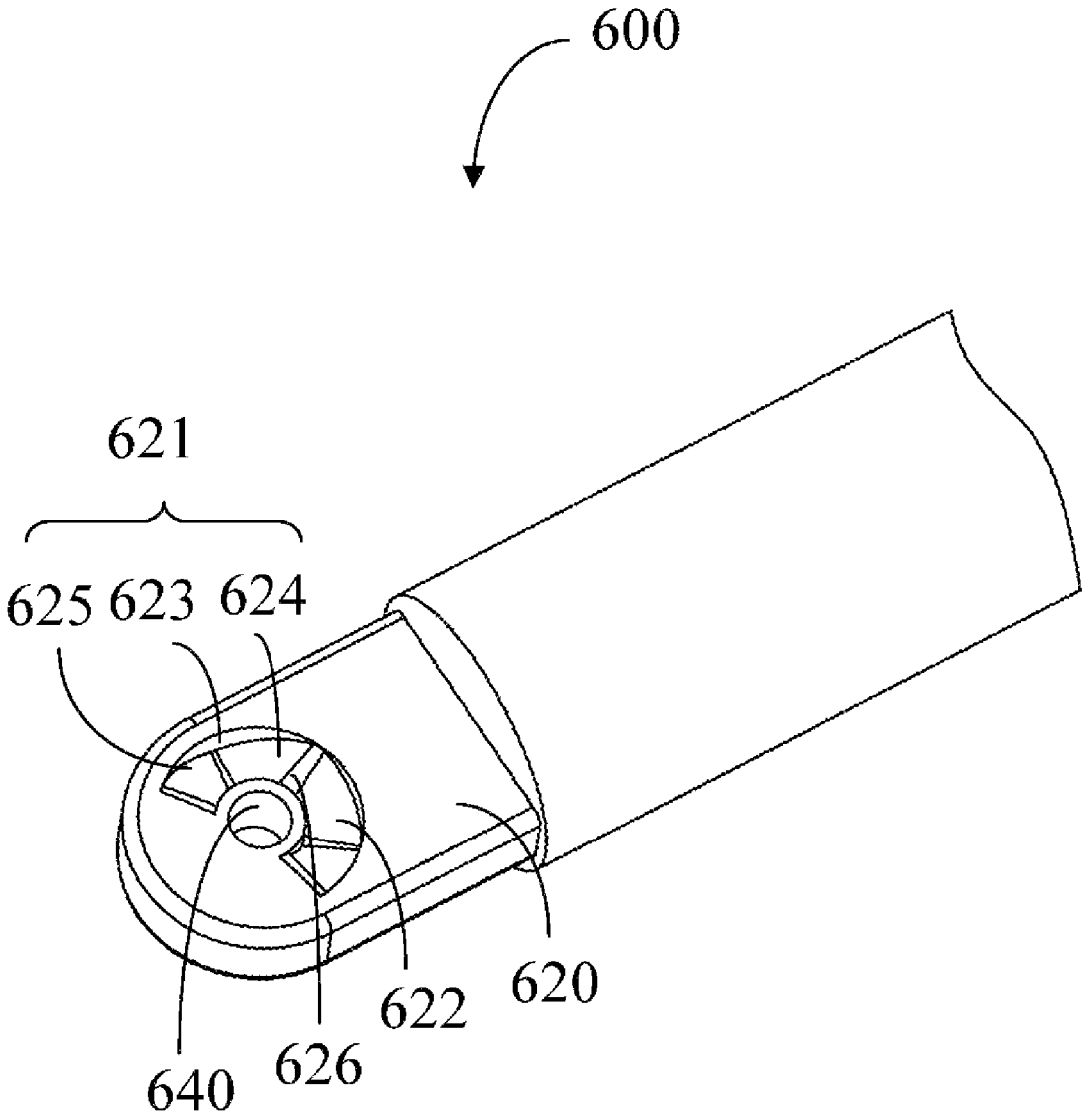
FIG. 7 is an isometric view of a leg of FIG. 4.

Referring to FIG. 7, the leg 600 is a thin rod and includes a connection end 610. The connection end 610 includes a first side 620 and a second side 630 (shown in FIG. 5) opposed to each other. A through hole 640 is formed on the connection end 610 and extends from the first side 620 to the second side 630. On the first side 620, a first concave portion 621 and a second concave portion 622 are formed to receive the projection portion 332 on the base member 300.

The first concave portion 621 and the second concave portion 622 are of the same configuration and positioned adjacent the through hole 630. The first concave portion 621 includes a cylindrical side surface 623, a first inclined surface 624, and a second inclined surface 625. The first concave portion 621 and the second concave portion 622 join together to form an edge 626.

After construction, the leg 600 is rotatably attached to the base member 300 via the pivot member 500. The coil spring 500 is retained at a first end to the head 410 of the pivot member 400, and at a second end to the second side 630 of the leg 600. The leg 600 can be retained in a first position and a second position, as shown in FIGS. 2 and 3, respectively.

In the first position, the projection 332 on the base member 330 is received in the first concave portion 621 on the leg 600. When in use, the leg 600 is rotated from the first position to the second position in which the projection 332 is received in the second concave portion 622 on the leg 600.

In the process of rotating the leg 600 from the first position to the second position, a relative movement occurs between the tip portion 336 on the projection portion 332 and the inclined surfaces of the first and second concave portions 621 and 622. Specifically, as the leg 600 is rotated, the edge 626 moves angularly with respect to the inclined surface of the first concave portion 621 toward the tip portion 336, and the connection end 610 thus moves away from the first wall 320 and towards the second wall 330, which compress the elastic member 500.

After the edge 626 moves pass the tip portion 336, the connection end 610 is urged to move back by the spring force of the elastic member 500 until the projection portion 332 is received in the second concave portion. The leg can be retained in the second position by the spring force of the elastic member 500. The process of rotating the leg 600 from the second position back to the first position is similar to the rotating process described above.

While one embodiment has been described and illustrated, the disclosure is not to be constructed as being limited thereto.

Various modifications can be made to the embodiments by those skilled in the art without departing from the true spirit and scope of the disclosure as defined by the appended claims.

What is claimed is:

1. A support assembly for a digital photo frame, comprising:

a base member comprising two side walls spaced from each other;

a pivot member attached across the two side walls to the base member;

a support arm comprising a connection end disposed between the two side walls and rotatably attached to the base member via the pivot member, wherein the connection end comprises a first surface and a second surface opposite to each other;

a positioning structure disposed on the first surface and the side wall opposite the first surface, comprising a projection portion and at least two concave portions, wherein the projection portion is capable of being received in the at least two concave portions, the two concave portions intersect to form an edge; and an elastic member retained by the pivot member and the second surface of the support arm, wherein the elastic member provides a spring force to urge the connection end of the support arm toward the side wall opposite the first surface;

wherein the projection portion is positioned on the side wall that is opposite the first surface, and the at least two concave portions are positioned on the first surface, the projection portion includes an upper cylindrical surface, a first lower inclined surface, and a second lower inclined surface, each of the at least two concave portions includes a cylindrical side surface, a first inclined surface, and a second inclined surface.

2. The support assembly according to claim 1, wherein the elastic member is a coil spring.

3. The support assembly according to claim 2, wherein the coil spring is placed onto the pivot member.

4. The support assembly according to claim 1, wherein the base member is mounded on a back portion of the digital photo frame.

5. The support assembly according to claim 1, wherein the support arm can be retained in a first position and a second position with respect to the base member.

6. A digital photo frame comprising:

a main body;

a support assembly disposed on the main body, comprising:

a base member comprising two side walls spaced from each other;

a pivot member attached across the two side walls to the base member;

a support arm rotatably attached to the base member via the pivot member comprising a connection end disposed between the two side walls, wherein the connection end comprises a first surface and a second surface opposite to each other;

a positioning structure disposed on the first surface and the side wall opposite the first surface comprising a projection portion and at least two concave portions, wherein the projection portion is capable of being received in the at least two concave portions, the two concave portions intersect to form an edge; and an elastic member disposed between an end of the pivot member and the second surface of the support arm, wherein the elastic member provides a pushing force to urge the connection end of the support arm toward the side wall opposite the first surface;

wherein the projection portion is positioned on the side wall that is opposite the first surface, and the at least two concave portions are positioned on the first surface, the projection portion includes an upper cylindrical surface, a first lower inclined surface, and a second lower inclined surface, each of the at least two concave portions includes a cylindrical side surface, a first inclined surface, and a second inclined surface.

7. The digital photo frame according to claim 6, wherein the elastic member is a coil spring.

8. The digital photo frame according to claim 7, wherein the coil spring is placed onto the pivot member.

9. The digital photo frame according to claim 6, wherein the base member is mounted on the back portion of the main body.

10. The digital photo frame according to claim 6, wherein the support arm can be retained in a first position and a second position with respect to the base member.

* * * * *